United States Patent [19]

Berg

[11] 4,106,195

[45] Aug. 15, 1978

[54] HAND TOOL FOR CUTTING AND FORMING AESTHETIC ENDS ON DECORATIVE MOLDING

[75] Inventor: Jack V. Berg, Woodbury, Minn.

[73] Assignee: Minnesota Mining and Manufacturing Company, Saint Paul, Minn.

[21] Appl. No.: 799,200

[22] Filed: May 23, 1977

[51] Int. Cl.[2] ..... B26B 29/00

[52] U.S. Cl. ..... 30/293; 30/178; 30/179; 30/229; 30/233

[58] Field of Search ..... 30/179, 178, 229, 233, 30/293

[56] References Cited

U.S. PATENT DOCUMENTS

| | | | |
|---|---|---|---|
| 2,085,079 | 6/1937 | Broadwell | 30/229 |
| 2,493,513 | 1/1950 | Wagner | 30/178 |
| 2,582,736 | 1/1952 | Altieri | 30/178 |
| 2,612,686 | 10/1952 | Wagner | 30/178 |
| 2,751,681 | 6/1956 | Hillson | 30/229 |
| 3,936,935 | 2/1976 | Gregory | 30/179 |

FOREIGN PATENT DOCUMENTS

| | | | |
|---|---|---|---|
| 969,731 | 5/1950 | France | 30/233 |
| 1,145,849 | 3/1963 | Fed. Rep. of Germany | 30/179 |

*Primary Examiner*—Al Lawrence Smith
*Assistant Examiner*—J. T. Zatarga
*Attorney, Agent, or Firm*—Cruzan Alexander; Donald M. Sell; John C. Barnes

[57] ABSTRACT

A hand tool having a cutting blade to cut and form ends on decorative molding is provided with a movable guide for supporting the molding material at different positions with respect to the blade such that ends and insert pieces may be cut from the molding material to form decorative ends on strips of molding material applied to a receptor surface.

1 Claim, 15 Drawing Figures

HAND TOOL FOR CUTTING AND FORMING AESTHETIC ENDS ON DECORATIVE MOLDING

BACKGROUND OF THE INVENTION

1. Field of the Invention

This invention relates to a hand tool for cutting strip material which has a movable guide to form various shapes of ends on decorative molding as it is applied to a receptor surface by an applicator.

2. Description of the Prior Art

In the prior art moldings have been formed to the exact length, and as formed, have finished ends to finish the decorative strips for particular products. Alternatively the material is extruded as endless strips and is later cut to form the desired finishing or decorative strip. It is preferred sometimes that the end be formed to asethetically define a leading or trailing end of the material, and in doing this from a continuous strip the end is cut such that it can be formed to have the appearance of a molded strip. One patent illustrating this is U.S. Pat. No. 3,959,538, issued May 25, 1976, to Theodore Loew. This patent illustrates several die patterns used for severing an extruded molding to be used for a trim strip. The various die configurations illustrated therein afford means for cutting the end of the molding and then bending the severed portions of the molding to match them together. These earlier known cutting tools form an end and then portions of the material are pressed together as the strip is applied to the receptor. In doing so the adhesive which is used to bond the molding strip to the receptor is placed under a shear stress as the bent or pressed ends tend to return to their original spaced position.

Other teachings of cutting the continuous molding are illustrated in an application assigned to the assignee of the present invention. This application is U.S. application Ser. No. 778,382, filed Mar. 17, 1977, in the name of Eugene H. Bergh. In this application a hand tool is utilized which can cut and form ends on the molding material. As illustrated therein, each type of end was prepared by a separate cutting tool having an anvil, a blade and a pair of cooperating guides which position the molding material with respect to the cutting knife to sever the strip material to the desired length and to cut from scrap material an insert which may be positioned in the severed end. To accomplish the result of providing the applicator with a tool by which he could form the ends of the decorative material to give an aesthetic appearance to the receptor it was necessary to have two or possibly three tools with which to form the ends of the decorative molding.

The tool of the present invention avoids the need for separate tools to cut the leading and trailing terminal ends of the molding material. It also cuts the material to form ends which do not place a shear force on the bonding adhesive.

The tool of the present invention comprises a cutting knife which cooperates with an anvil to cut the molding material. A movable guide, which is pivotally mounted to predetermined fixed positions about the anvil, supports the molding material to effect cuts to form right and lefthand leading ends on strips of molding material and will form a butt cut or a miter cut trailing end as well. The guide will also support scrap materials from which may be cut mating insert pieces for the right and lefthand leading ends and the terminal end.

SUMMARY OF THE PRESENT INVENTION

The present invention provides a hand tool which can cut from a continuous strip of decorative molding material terminal ends on the leading and trailing terminal ends and cut inserts for said ends to provide finished aesthetic appearance for the ends of the applied molding material. The hand tool comprises an anvil having a support surface shaped to support a surface of said molding material. A cutting knife having a V-shape is supported opposite the anvil for cutting the molding material supported thereon. The anvil is supported by one support member connected to a handle and the knife is supported by a second handle pivotally supported by said first handle such that upon movement of said handles toward each other the knife will move toward the anvil surface. A channel-shaped guide member adapted to receive and support opposite edges of the molding material is pivotally mounted to the tool by an axis generally perpendicular to the anvil surface. Indexing means in the form of a pin and slot are formed on the guide member and on said anvil support member for placing said guide member and a length of molding material at various predetermined fixed positions on said anvil surface in relationship to said V-shaped knife to cut the molding material and to cut the insert pieces to the desired shape to match the cut in the strip of molding material.

The tool of the present invention permits the applicator to apply continuous strips of molding material to various surfaces and to form terminal ends to the applied strips which give an aesthetic appearance and the molding material an appearance of being custom molded pieces.

DESCRIPTION OF THE DRAWING

The present invention will be described in greater detail hereinafter with reference to the accompaying drawing wherein.

Figure 8:
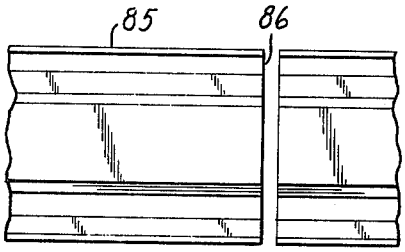
Figure 9A:
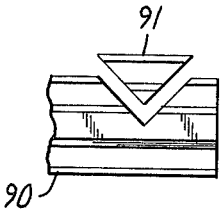
Figure 9B:
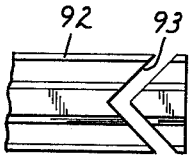
Figure 9C:
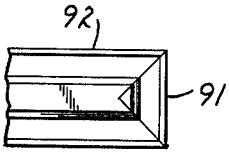

FIGS. *6a, 6b,* and *6c* are illustrative of the cutting of the insert piece, cutting of the terminal trailing end from the molding material and a finished end on the molding material with the insert piece in the terminal trailing end to form the aesthetic end, respectively;

FIGS. *7a, 7b* and *7c* illustrate a leading end embodiment for a strip of molding material with figure *a* showing the cutting of the insert piece, cutting the terminal end of the molding material, and a finished end for the leading end of the decorative strip, respectively;

FIG. 8 illustrates the butt cutting of a strip of molding material; and

FIGS. *9a, 9b,* and *9c* illustrate the cutting of a narrower strip of molding material to form the insert piece, the terminal end, and the finished end, respectively.

DETAILED DESCRIPTION OF THE PRESENT INVENTION

Figure 1:
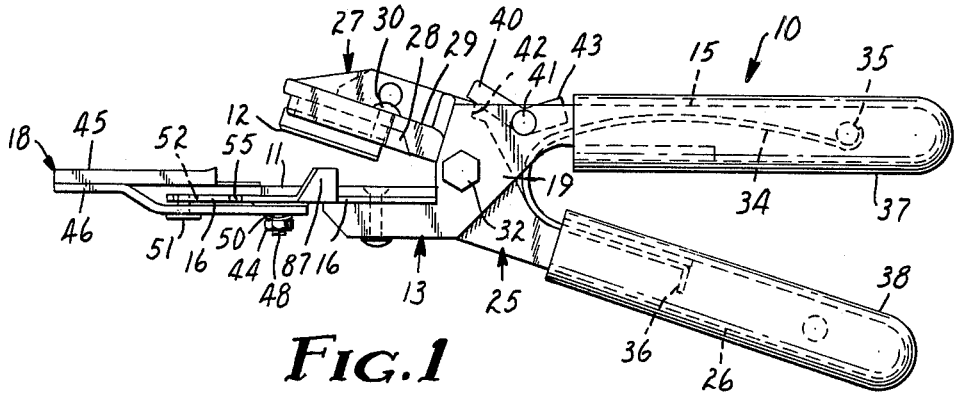
FIG. 1 is a side elevational view of a cutting tool formed in accordance with the present invention.
Figure 5:
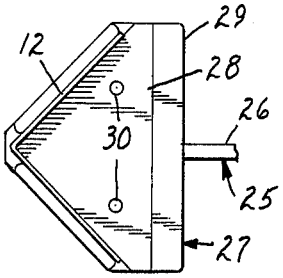
FIG. 5 is a fragmentary detailed view of the cutting knife and the support therefor.
Figure 6A:
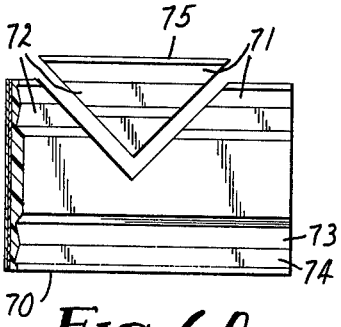
Figure 6B:
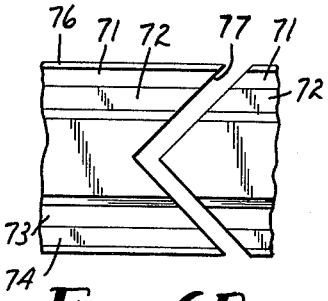
Figure 6C:
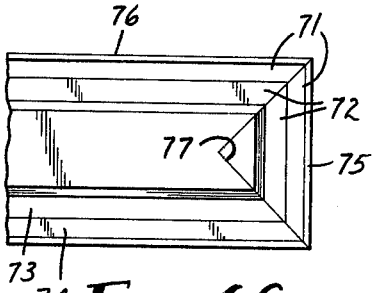
Figure 7A:
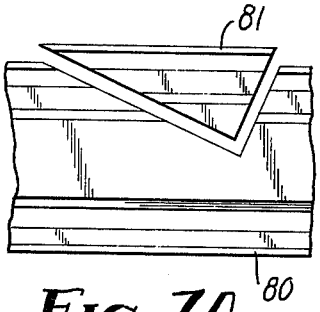
Figure 7B:
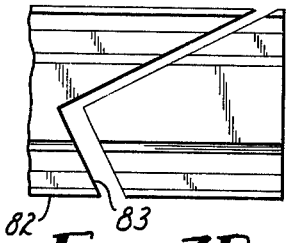
Figure 7C:
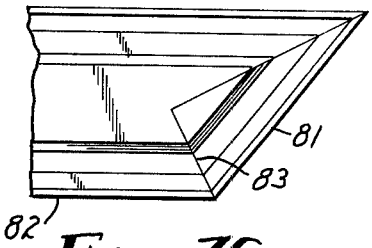

Referring now to FIG. 1 there is illustrated a hand tool generally designated 10 useable for the cutting of molding material to form aesthetic terminal ends at the leading and trailing ends of a strip on a receptor surface. The hand tool 10 comprises an anvil 11 on which the molding material is supported for cutting by a cutting knife or rule die 12. The anvil is supported by a support member or is formed as part of a support member including a body 13 and a handle 15. The body 13 includes a plate 16 extending beyond the anvil, which plate 16 supports the pivot axis for a guide member generally designated 18 and the plate 16 has indexing slots for positioning the guide member 18 in fixed positions with respect to the knife 12. The body 13 is comprised of a pair of spaced plates 19 and 20 between which is received and pivotally connected thereto a support 25 for the knife 12 which support includes a handle 26 and a head 27. The head 27 is formed of a pair of plates 28 and 29 which are formed to fit together and secure the cutting knife 12 in the locked position therebetween with the knife positioned in a generally V-shape with the cutting edges of the blade meeting substantially at 90° with respect to each other symmetrically at the center of the tool. The plates 28 and 29 are secured together by suitable fasteners 30, see FIG. 5.

The support member 13 and the support member 25 are pivotally connected about a pin or fastening member 32 such that movement of the handles 15 and 26 toward each other will move the cutting knife 12 toward the surface of the anvil 11. Return of the handle to an open position for moving the knife 12 away from the anvil is accomplished by a return spring 34 which is a leaf-type spring. Spring 34 is supported at one end by a pin 35 between the plates 19 and 20 and the opposite end is formed with a leg 36 bent and formed to fit in an opening in the support 25. Decorative and protective molded covers 37 and 38 are placed over the supports 13 and 25, respectively, to cover the members and the ends of the spring 34 and form comfortable handles.

A locking lever 40 is pivotally connected at 41 to the support 13 between the plates 19 and 20 such that when the knife 12 is positioned in contact with the surface of the anvil 11 the locking lever 40 may be pivoted about the pin 41 to bring one end thereof against a stop 42 on support 25 such that the hand tool will stay in a closed position to protect the knife 12. This lock may be readily released by gripping the handles 15 and 26 and pivoting the locking lever 40 by applying pressure against the surface of the other leg 43 such that it will pivot in the opposite or clockwise direction as shown in FIG. 1 about the axis 41.

The molding material to be cut is supported in an elongate channel-shaped member 45 which is part of the guide member 18. The channel-shaped member 45 comprises a base, upturned flanges to engage opposite edges of the molding material, and inwardly extending edges for holding the opposite edges of the continuous strip of molding material inserted in the guide member and extending therefrom onto the anvil 11. The channel-shaped member 45 is supported on an arm 46 which extends beneath the plate 16 and is formed with an opening 47 through which extends the fastening bolt 48. The opening 47 is slightly larger than the diameter of the bolt 48, and the bolt 48 has the head thereof supported in a recess 49 formed in the plate 16 directly beneath the anvil 11. A scalloped spring washer 50 is positioned between the arm 46 and the locking nut 44 to permit the arm 46 to be moved away from the plate 16 against the bias of the washer 15 to withdraw a pin 51, which is part of an indexing means, from a notch positioned about the periphery of the plate 16. The guide member 18 is indexed about the axis formed by the fastening member 48 by moving the same against the pressure of the spring 50 to withdraw the pin 51 from a detent defined as a hole or notch in the anvil support plate 16 and then to pivot the same about the axis 48 until the pin 51 is placed in a different detent. This indexing of the guide member permits the molding material to be positioned on the anvil in different positions with relationship to the knife 12 such that the V-shaped blade can cut notches of various depth into the molding material.

Figure 2:
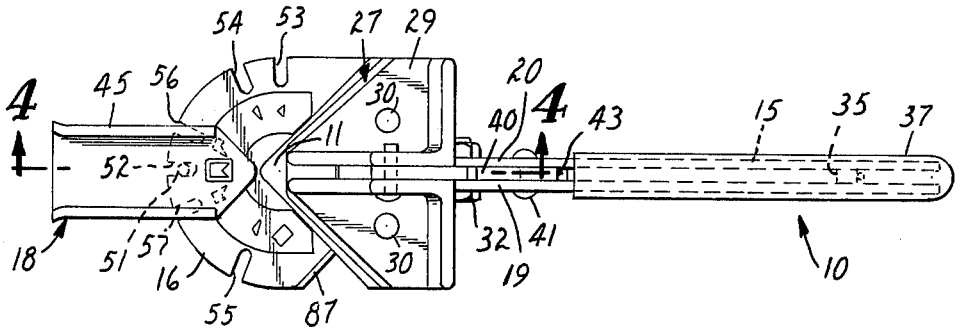
FIG. 2 is a plan view of the tool of FIG. 1.

As shown in FIG. 2 the plate 16 is formed with a notch 52 which positions the guide member 18 and molding material symmetrically with respect to the blade 12. A notch 53 positions the molding material perpendicular to the position it assumes when the guide member is indexed with notch 52. A pair of notches 54 and 55 are symmetrically positioned to position the molding material such that insert pieces may be cut from the side of the molding material to form insert pieces for right and lefthand leading edges of the severed strip as illustrated in FIG. *7a* and notches 56 and 57 which are symmetrically located to the right and lefthand of the notch 52 permit the cutting by the knife 12 of the terminal end of the strip of molding material to form the terminal end as illustrated in FIG. *7b*.

Turning now to FIGS. *6a, b,* and *c* there is illustrated a molding material 70. This molding material is an extruded colored polymeric material along two sides of which are stripes of vapor-coated reflective material on facets 71, 72, 73, and 74. The opposite side of the material is generally flat and a pressure-sensitive adhesive is applied thereto, which is covered by a release liner. To form from this material an aesthetic terminal trailing end on a strip of molding material a scrap piece is cut to form a triangular-shaped insert 75. This insert piece 75 may be cut by the knife 12 with the guide member 18 indexed with the pin 51 in the notch 53. The applicator then takes the tool and cuts the applied strip 76 of molding material to form the terminal cut 77 as shown in FIG. *6b* with the guide member indexed to notch 52. The insert piece 75 is then positioned in the notch 77 and forms a finished end as illustrated in FIG. *6c*. In this position the vapor-coated facets 71, 72, 73, and 74 appear to extend around the end giving the terminal end a pleasant finished appearance.

Referring now to FIGS. *7a, 7b,* and *7c,* there is illustrated a strip 80 from which an insert piece 81 is cut and a strip of molding material 82 which is terminated by the formation of a notch 83. In FIG. *7c* the insert piece 81 is placed in the notch 83 of the strip 82 to form an attractive appearing termination at the leading end of the strip of molding material. This strip could be applied to the righthand side of an automobile for example. The insert piece 81 is formed by indexing the guide member 45 to the position in notch 54. The notch 83 is made by inserting the molding strip 82 in the channel 45 with the guide member indexed to notch 57.

To form a piece of molding material for the lefthand side of the vehicle similar cuts could be formed by notches 55 and 56, respectively.

Figure 3:
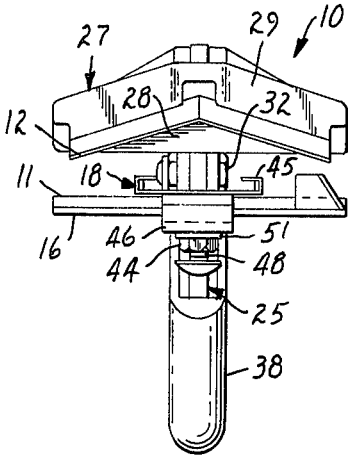
FIG. 3 is a front elevational view of the tool of FIG. 1.
Figure 4:
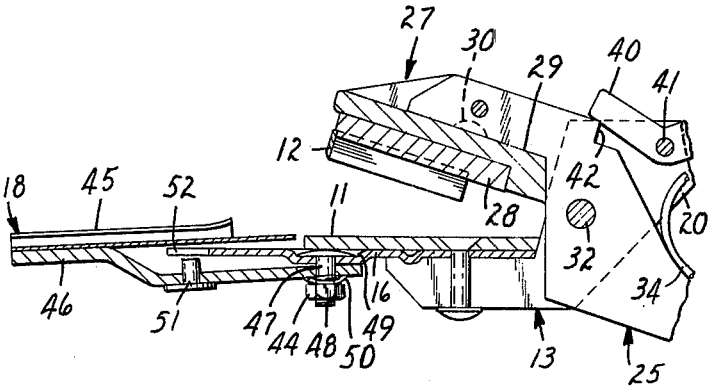
FIG. 4 is an enlarged vertical sectional view showing the mounting of the guide member.

A square or butt cut can be formed in the molding material as indicated in FIG. 8 for the strip of molding material 85. This square cut 86 can be made by positioning one edge of the molding material 85 against a guide member 87 disposed along and extending vertically from one endge of the plate 16 as illustrated in FIGS. 1, 2, and 3. Cuts of this nature are useful when applying the molding material to the side of an automobile when the strip reaches the edges of a door and is going to continue past the edge of the door.

The dimension of the channel member 45 may vary, depending on the width of the decorative molding material. In FIGS. *9a, 9b,* and *9c* there is illustrated a narrower strip of molding material 90 from which an insert piece 91 has been cut, and the applied molding material 92 is formed with a notch 93 at its terminal end such that the insert piece 91 may be inserted into the notch to form a terminal end as shown in FIG. *9c.* In this material as in other materials which are symmetrical about a longitudinal axis, the cutting tool of this invention permits the formation of terminating ends at the leading or trailing end of the molding material which will give the material the appearance of a custom molded item.

Having thus described the present invention with respect to the illustrated embodiment, it will be appreciated that various changes may be made in the appearance or details of its construction without departing from the spirit and scope of the present invention as defined in the appended claims.

What is claimed is:

1. A hand tool for cutting preformed continuous flexible strips of decorative molding material and forming terminal leading and trailing ends on the cut strips, said tool comprising an anvil support member having a support surface shaped to support a surface of said molding material, a cutting knife having a V-shape for cutting said molding material when disposed on said anvil, said cutting knife being adapted to cut a predetermined notched pattern in the molding material, a support member for supporting said anvil and including a first handle, a support for said knife including a second handle pivoted to said first handle, a guide member comprising an elongate channel-shaped member adapted to support a length of said molding material, said guide member being pivotally mounted to said anvil support member about a pivot axis perpendicular to said anvil support surface to afford adjustment about a pivot axis, and indexing means on said guide member and on said anvil support member for placing said guide member and a length of molding material at various predetermined fixed positions on said anvil surface in relationship to said knife said indexing means including two notches formed in the anvil support surface, one notch positioned on a line bisecting the V-shape of said blade and the other at ninety degrees with respect to said one notch to form a symmetrical cut on the molding material and an insert, pairs of notches to the right hand and left hand sides of said anvil support surface and said one notch at symmetrical locations for cutting left and right hand pointed leading ends from the molding material and the mating inserts, and pins means on said pivoted guide member spaced from said pivot axis to be received in a selected one of said notches for accurately locating said molding material with respect to said V-shaped blade.

* * * * *